US009988824B2

(12) United States Patent
Bottome et al.

(10) Patent No.: US 9,988,824 B2
(45) Date of Patent: Jun. 5, 2018

(54) TREEPOD ASSEMBLY

(71) Applicants: Ricardo Bottome, Boulder, CO (US); Michael Cecot-Scherer, Louisville, CO (US)

(72) Inventors: Ricardo Bottome, Boulder, CO (US); Michael Cecot-Scherer, Louisville, CO (US)

(73) Assignee: Canaima Outdoors, Inc., Boulder, CO (US)

( * ) Notice: Subject to any disclaimer, the term of this patent is extended or adjusted under 35 U.S.C. 154(b) by 0 days. days.

(21) Appl. No.: 15/429,853

(22) Filed: Feb. 10, 2017

(65) Prior Publication Data

US 2017/0234025 A1 Aug. 17, 2017

Related U.S. Application Data

(60) Provisional application No. 62/294,117, filed on Feb. 11, 2016.

(51) Int. Cl.

| | |
|---|---|
| ***E04H 15/04*** | (2006.01) |
| ***E04H 15/24*** | (2006.01) |
| *E04H 15/20* | (2006.01) |

(52) U.S. Cl.

CPC ..... *E04H 15/04* (2013.01); *E04H 15/24* (2013.01); *E04H 2015/205* (2013.01); *E04H 2015/208* (2013.01)

(58) Field of Classification Search

CPC ..... E04H 15/04; E04H 15/14; E04H 15/10; E04H 15/24; E04H 15/56; E04H 15/34; E04H 15/32; E04H 2015/205; A45F 3/22; A45F 3/52; A45F 3/26

USPC ..... 135/90, 91, 93, 100, 115, 156, 116, 119; 5/120–121, 126–128

See application file for complete search history.

(56) References Cited

U.S. PATENT DOCUMENTS 3,545,461 A * 12/1970 Carlson ..... E04H 15/04 135/100
4,320,542 A * 3/1982 Cohen ..... E04H 15/04 5/121
4,526,307 A * 7/1985 Parker ..... E04H 15/04 135/95
4,825,578 A * 5/1989 Robinson ..... A01M 31/025 135/90

(Continued)

OTHER PUBLICATIONS

HugglePod, http://www.hearthsong.com/nylon-canvas-hugglepodhangout-with-led-lights.htm.

(Continued)

*Primary Examiner* — Winnie Yip
(74) *Attorney, Agent, or Firm* — Lewis Brisbois Bisgaard & Smith LLP

(57) ABSTRACT

The invention provides means, methods, and devices for suspending persons and goods above the ground while outdoors. Particularly, the invention provides a treepod assembly having a tent and a suspension element, capable of securely supporting at least one occupant while suspended above the ground from a tree or other elevated structure. In some embodiments, the treepod assembly may further include a rigid frame for additional support. Certain embodiments include an inflatable pocket that protects occupants and items inside the tent from injury or damage in case of a fall and impact with the ground.

19 Claims, 14 Drawing Sheets

(56) References Cited

U.S. PATENT DOCUMENTS

| | | | | |
|---|---|---|---|---|
| 5,042,517 | A * | 8/1991 | Stewart | E04H 15/04 135/115 |
| 5,078,096 | A | 1/1992 | Bishop | |
| 5,362,017 | A * | 11/1994 | Puckett | B64D 17/025 244/145 |
| 6,877,521 | B2 | 4/2005 | Webster et al. | |
| 7,051,385 | B2 * | 5/2006 | Gardner | A47C 17/84 5/122 |
| 8,555,910 | B2 | 10/2013 | Webster et al. | |
| 9,254,446 | B2 | 2/2016 | Lacy et al. | |
| 9,347,238 | B2 * | 5/2016 | Dominick | E04H 15/04 |
| 9,630,119 | B2 * | 4/2017 | Fries | A63H 33/008 |
| 2002/0189656 | A1 * | 12/2002 | David | A45B 25/02 135/25.1 |
| 2004/0006820 | A1 * | 1/2004 | Saiki | A47C 17/84 5/111 |
| 2010/0252083 | A1 * | 10/2010 | Ogle | E04H 15/04 135/90 |

OTHER PUBLICATIONS

Tree Hammocks, https://www.wayfair.com/outdoor/sb0/tree-hammocks-c1864033.html.

"What is a Treepee®?" Live Life Outdoors International Ltd., © 2007, 2 pages [retrieved from: www.treepee.com].

* cited by examiner

TREEPOD ASSEMBLY

CROSS-REFERENCE TO RELATED APPLICATION

This application claims priority to and the benefit of U.S. Provisional Patent Application 62/294,117, filed Feb. 11, 2016, the entirety of which is incorporated herein by reference.

FIELD OF THE INVENTION

The present invention pertains to portable and/or temporary outdoor structures for storing or supporting persons and/or goods, and particularly to tents and like structures that are capable of being suspended above the ground, such as from a tree by means of a rope or strap.

BACKGROUND OF THE INVENTION

In the course of camping or other outdoor recreational activities, placement or storage of persons, items, or equipment in close proximity to the ground may cause a number of problems. The ground of an outdoor environment presents many potential contaminants and/or irritants, including but not limited to water, insects, sharp objects, rocks, and dirt, which may damage tents or other items, contaminate stored food or equipment, or be offensive to campers or hikers. In certain environments, larger animals, such as bears and mountain lions, may also pose a danger to persons and items on the ground.

There is thus a need in the art for a structure that separates users and their items and equipment from the ground to protect them from damage, contamination, and other hazards.

SUMMARY OF THE INVENTION

The present disclosure provides a new and novel structure. One aspect of the present disclosure is a treepod assembly including a suspension element. The treepod assembly may be suspended from a tree or other structure by a rope or strap interconnected to the suspension element. In this manner, a bottom portion of the treepod assembly does not contact the ground. Thus, in use, a bottom portion of the treepod assembly is separated from contaminants (such as water, insects, sharp objects, rocks and dirt) that may be present on the ground. In this manner, the treepod assembly is protected from damage. Similarly, users of the treepod assembly are protected from crawling insects and other hazards present on the ground. In one embodiment, the treepod assembly includes a frame to support the users. In another embodiment, the treepod assembly is devoid of a frame. In still another embodiment, the treepod assembly comprises a platform portion. The user may position a tent on the platform. In yet another embodiment, the treepod assembly comprises an integral tent interconnected to the platform.

Another aspect of the present disclosure is a treepod assembly comprising a pocket formed between a first material layer and a second material layer. The pocket includes apertures of a predetermined size. When the treepod assembly is suspended off of the ground from a tree or other elevated structure, the apertures enable air to enter the pocket to at least partially inflate the pocket. In this manner, the pocket forms a cushion. If the strap used to suspend the treepod assembly fails, impact with the ground causes a release of the air through the apertures. The pocket protects occupants from the impact. In one embodiment, the apertures enable air to enter the pocket faster than air can exit the apertures. The apertures may include baffles to direct, or limit, the flow of air into and/or out of the pocket.

In accordance with one aspect of the present disclosure, a novel treepod assembly is provided. The treepod assembly includes, but is not limited to: (1) a pocket comprising a first layer of material interconnected to a second layer of material; (2) air apertures formed in the pocket; and (3) a suspension element interconnected to the pocket. In one embodiment, the treepod assembly further comprises a tent, an upper portion of the pocket forming a bottom portion of the tent. In another embodiment, the apertures are positioned in the upper portion of the pocket.

In accordance with still another aspect of the present disclosure, a treepod assembly is provided, comprising a tent, having a substantially rectangular footprint and comprising an internal chamber and at least one of a vent and a window, the internal chamber having at least one opening and a floor; at least one suspension element, the at least one suspension element having sufficient strength to support the weight of the treepod assembly and the at least one occupant while the treepod assembly is suspended above the ground by the suspension element from an elevated structure; and a rigid, substantially rectangular frame, wherein the floor of the internal chamber and the rigid frame are made of appropriate materials and configured to support the weight of at least one occupant. In embodiments, the at least one of a vent and a window may be substantially semicircular. In embodiments, the at least of a vent and a window may comprise at least one vent, the at least one vent being partially covered by a vent cover disposed on an external face of the tent. In embodiments, the at least one of a vent and a window may be disposed on an external face of the tent other than the face on which the at least one opening is disposed. In embodiments, the at least one suspension element may be a hook or loop disposed on a top of an external surface of the tent. In embodiments, the treepod assembly may be capable of supporting a weight of at least about 500 pounds when suspended above the ground.

The above-described embodiments, objectives, and configurations are neither complete nor exhaustive. As will be appreciated, other embodiments of the invention are possible using, alone or in combination, one or more of the features set forth above or described in detail below.

As used herein, the term "treepod assembly" refers to a structure that is able and adapted to remain securely suspended above the ground from an elevated structure while occupied by at least one person.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

The Summary is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and, together with the general description of the disclosure given above and the detailed description of the drawings given below, serve to explain the principles of the disclosure. It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein. In the drawings.

DETAILED DESCRIPTION

Figure 2:
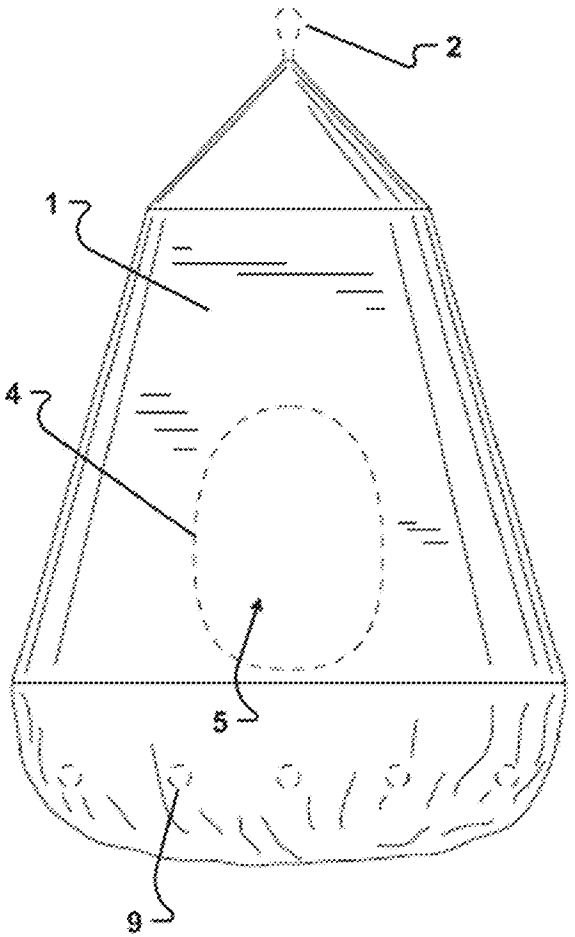
FIG. 2 is a front view of a treepod assembly according to the present invention.
Figure 1:
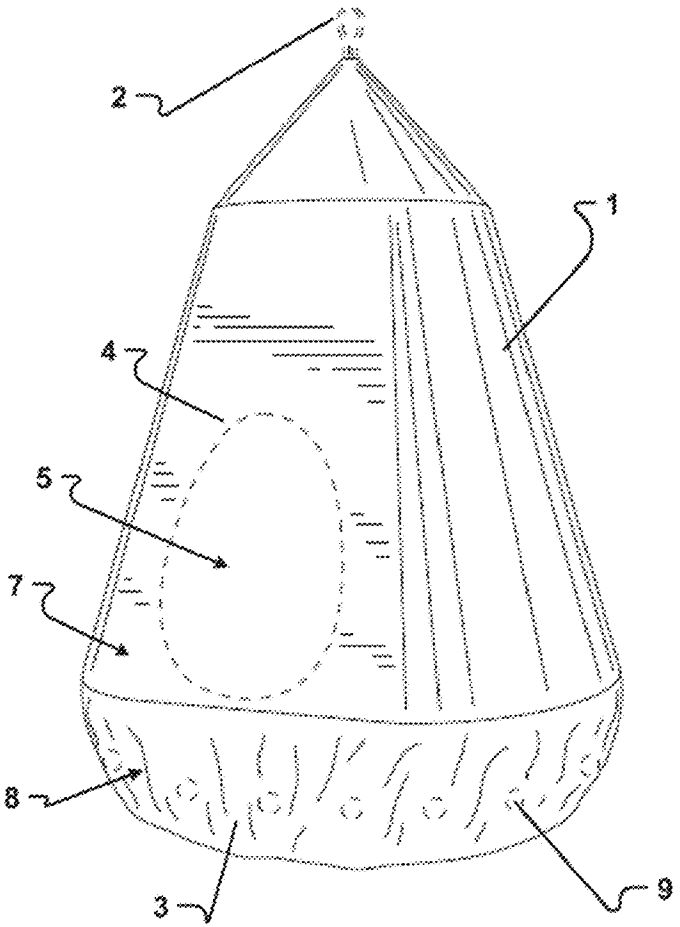
FIG. 1 is a perspective view of a treepod assembly according to the present invention.
Figure 4:
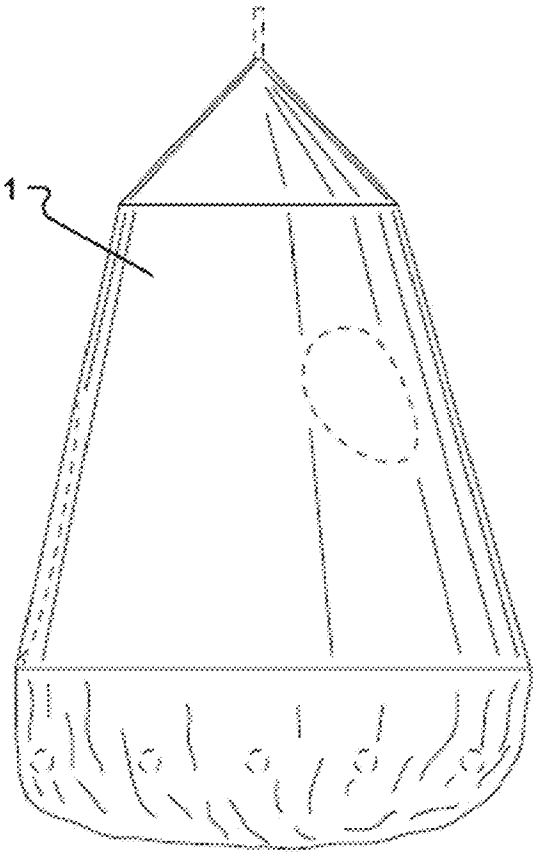
FIG. 4 is a right side view of a treepod assembly according to the present invention.
Figure 3:
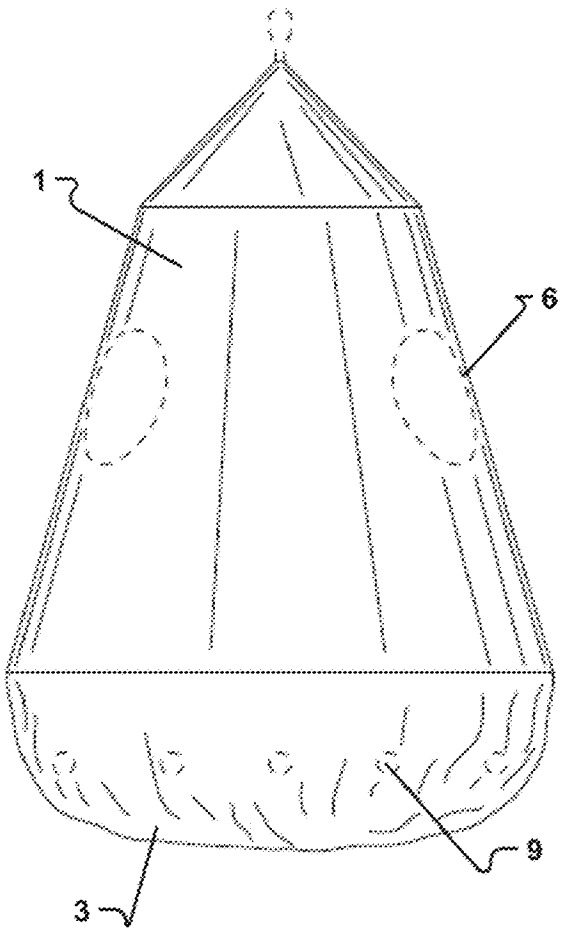
FIG. 3 is a back view of a treepod assembly according to the present invention.
Figure 6:
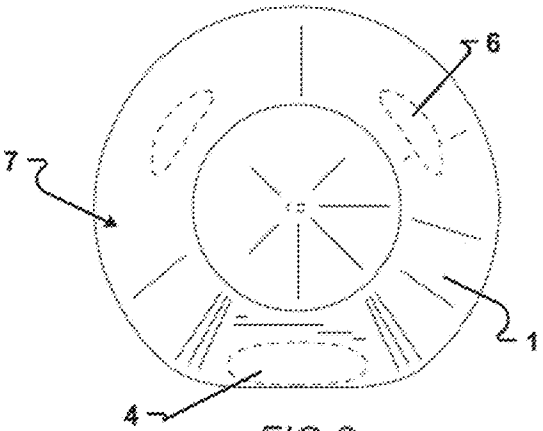
FIG. 6 is a top view of a treepod assembly according to the present invention.
Figure 7:
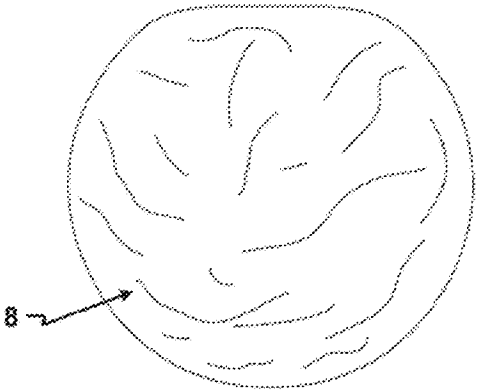
FIG. 7 is a bottom view of a treepod assembly according to the present invention.
Figure 5:
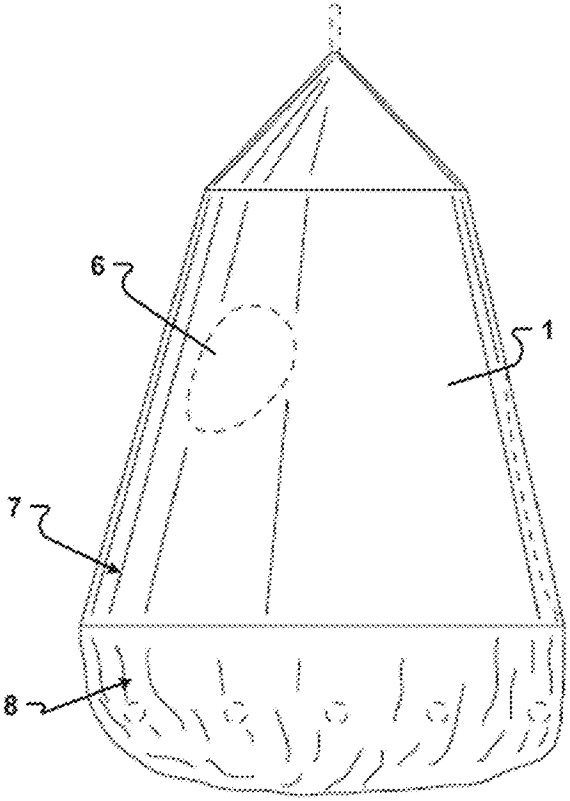
FIG. 5 is a left side view of a treepod assembly according to the present invention.

The following Components List identifies various features of the present invention by their reference numbers in the drawings.

COMPONENTS LIST

1 Tent
2 Suspension element
3 Pocket
4 Opening
5 Internal chamber
6 Window and/or vent
  6*a* Window
  6*b* Vent
7 First layer of material
8 Second layer of material
9 Aperture
10 Rod
  10*a* Straight rode
  10*b* Arcuate rod
11 Connector
12 Vent cover
13 Frame
14 Flexible Support Elements Referring now to FIGS. 1-11, a treepod assembly of an embodiment of the present disclosure is illustrated. The treepod assembly generally comprises a tent 1, a suspension element 2, and a pocket 3. Although not illustrated, the treepod assembly may also include attachment points for interconnection of stability lines. The attachment points may comprise hooks. Additionally or alternatively, the attachment points may comprise loops of fabric or cord. In one embodiment, the treepod assembly includes at least three attachment points spaced substantially evenly radially around a portion of the treepod assembly proximate to a bottom portion.

The tent 1 includes an opening 4 to an internal chamber 5. The opening 4 may include a closure, such as, by way of non-limiting example, a zipper, which may allow a user of the treepod assembly to selectively reconfigure the opening 4 between an open configuration and a closed figuration to selectively allow or prevent entry into or exit from the tent 1. One or more windows or vents 6 may also be formed on the tent 1. A floor of the chamber 5 supports an occupant. In one embodiment, a fabric material of the floor is sufficiently rigid to support the occupant without a frame. For example, in one embodiment, the treepod assembly can support two or three children, or one adult, without a frame.

The suspension element 2 may comprise a hook or loop of any type with sufficient strength to support the treepod assembly and its occupants from an elevated structure, such as a tree. Although only one suspension element 2 is illustrated, it will be appreciated that the treepod assembly may include any number of suspension elements 2. For example, the treepod assembly may include two, three, four, or more suspension elements 2. In one embodiment, the suspension element 2 is interconnected to an upper portion of the treepod assembly. However, the position of the suspension element 2 may be altered.

The tent 1 generally comprises a first layer of material 7. A pocket 3 is provided that comprises a second layer of material 8 that is interconnected to the first layer of material 7. The second layer 8 is interconnected to the first layer 7 such that when the treepod assembly is suspended above the ground, the second layer 8 drapes freely away from the first layer 7 and the tent 1. Air enters the pocket 3 through apertures 9. In this manner, the pocket 3 is at least partially inflated when the treepod assembly is suspended above the ground. The apertures 9 are sized to allow air to enter the pocket 3 without obstruction. However, if the treepod assembly falls to the ground, the apertures 9 restrict the flow of air from the pocket 3. In this manner, the pocket 3 protects occupants of the treepod assembly from impact with the ground. Said another way, the pocket 3 reduces the peak deceleration of the treepod assembly upon falling to the ground by extending the duration of the deceleration. In one embodiment, the apertures 9 are formed in the second layer 8. Additionally or alternatively, apertures 9 may be formed in the first layer 7.

The apertures 9 may further be adapted, or arranged, to decrease, or prevent, the flow of air from the pocket 3. In one embodiment, the apertures 9 are positioned on an upper portion of the pocket 3 and within the chamber 5 of the tent 1.

In one embodiment, the apertures 9 are generally circular. However, the apertures 9 may be of any size or shape. Further, although the apertures 9 are illustrated substantially evenly spaced axially on the second layer 8, the apertures 9 may have an irregular spacing and may be positioned in different portions of both the second layer 8 and the first layer 7.

The first layer 7 and the second layer 8 may be formed of any material known to those of skill in the art. In one embodiment, the first and second layers 7, 8 are made of the same material.

Apertures 9 may be positioned within the chamber 5 through the floor of the tent 1. In one embodiment, the aperture 9 has a generally triangular shape. However, other shapes of the aperture 9 are contemplated. Aperture 9 also may, but need not, comprise a screen, flap, cover, or other equivalent feature that allows air to freely enter the pocket but restricts airflow out of the pocket to dampen the forces felt by the treepod assembly and its occupants if the suspension of the treepod assembly above the ground fails or the treepod assembly otherwise drops to the ground.

Figure 12:
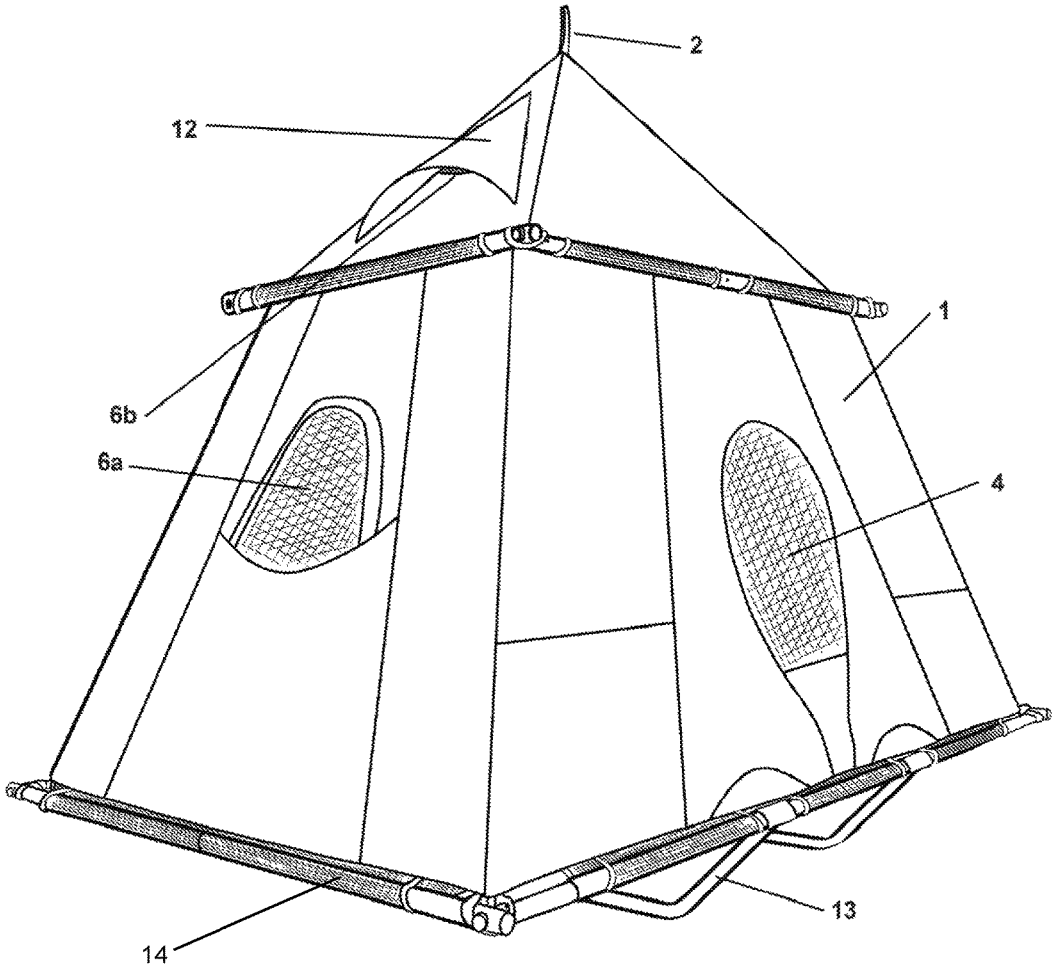
FIG. 12 is a 45° angle view of a treepod assembly according to the present invention.

The treepod assembly may further include a frame. The frame may generally comprise a rigid assembly interconnected to flexible support elements 14 (see FIG. 12). The rigid assembly may be interconnected to the suspension element 2 by the flexible elements. The rigid assembly may be generally horizontal and the suspension elements may be generally vertical.

Any suitable material may be used to form the rigid assembly. In one embodiment, the rigid assembly comprises aluminum. In another embodiment, the rigid assembly is formed of a lightweight metal or alloy. In still another embodiment, the rigid assembly is formed of a plastic material. Additionally or alternatively, the assembly may include a stretchable cord, such as a shock cord.

The flexible support elements may be formed of any suitable wire or cord. In one embodiment, the flexible support elements have an elastic elongation that is relatively low. In another embodiment, the flexible support elements are formed of a high modulus polyethylene (HMPE). In one embodiment, the flexible elements comprise AmSteel® or AmSteel-Blue®. In another embodiment, the flexible elements are formed of an ultra-high molecular weight polyethylene (UHMWPE) material such as, but not limited, to Dyneema®.

In one embodiment, the rigid assembly comprises a lower assembly spaced from an upper assembly. The lower assembly may have at least one of a length and a width that is larger than a corresponding length and width of the upper assembly. The lower and upper assemblies may be generally planar.

Figure 8A:
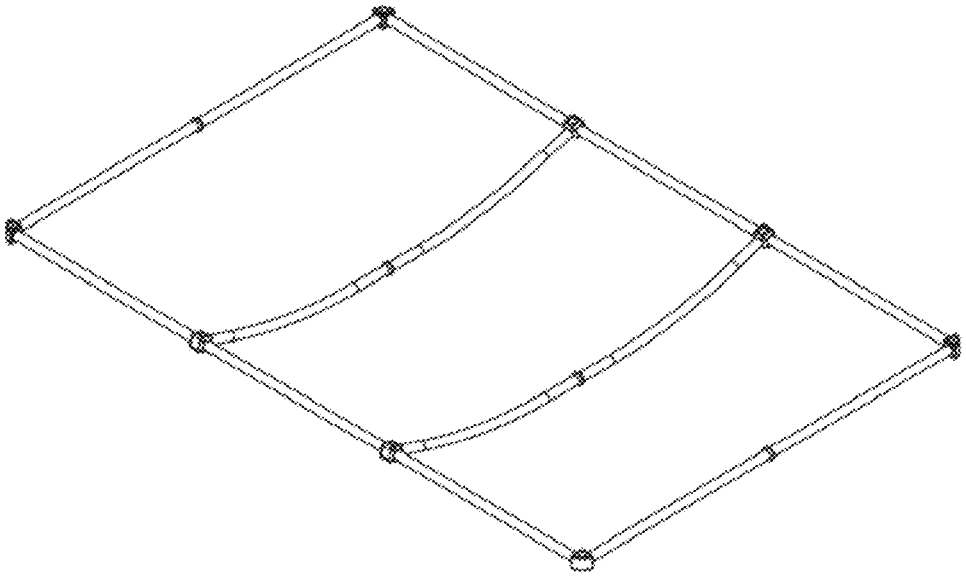
FIGS. 8A and 8B illustrate a first embodiment of a lower assembly according to the present invention.
Figure 8B:
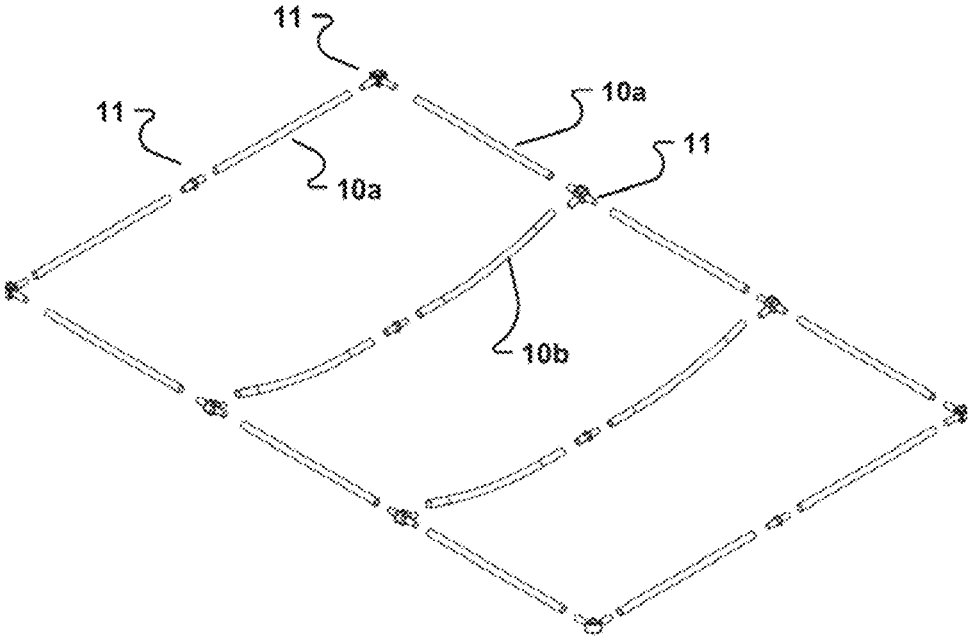
Figure 9A:
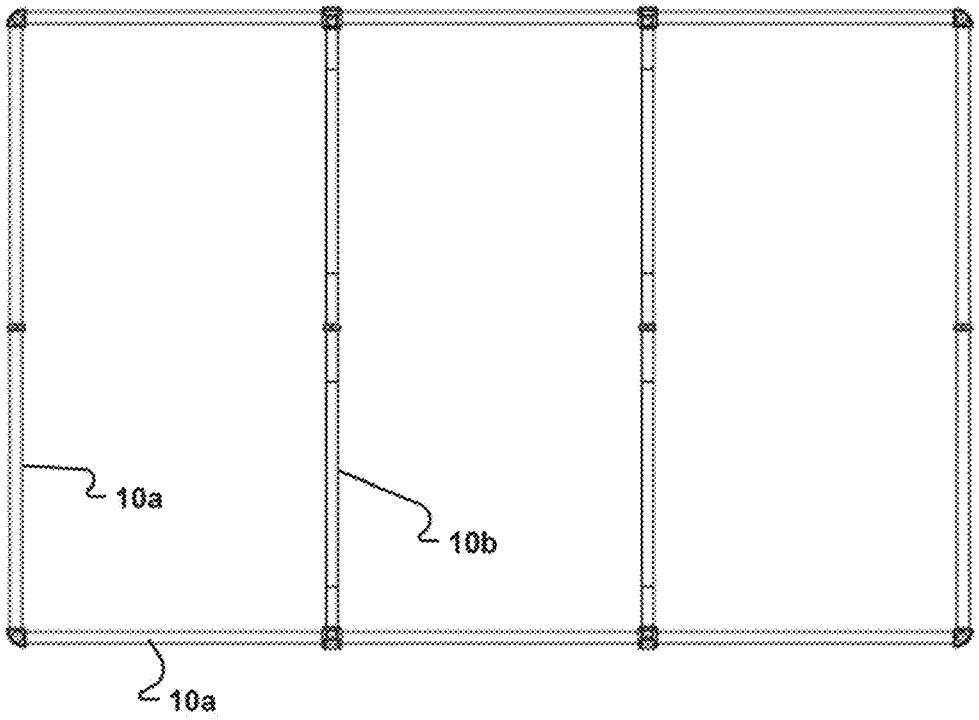
FIGS. 9A and 9B are top and front elevation views, respectively, of the first embodiment of a lower assembly according to the present invention.
Figure 9B:
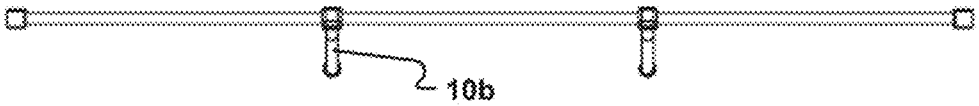

Referring now to FIGS. 8 and 9, a first embodiment of a lower assembly is illustrated. The lower assembly is generally rectangular. As illustrated in the exploded view of FIG. 8B, the lower assembly comprises rods 10*a,b* interconnected together by connectors 11. The lower assembly may have any desired length and width. In one embodiment, the length is between about 6 feet and about 10 feet and the width is between about 3 feet and about 6 feet. Optionally, at least some of the rods 10*b* may have an arcuate shape to provide a depression in a medial portion of the assembly. Accordingly, the assembly may have a height of between about 1 inch and about 8 inches. In a preferred embodiment, the height of the assembly is about 5.6 inches. In another embodiment, the first embodiment of the lower assembly has a size sufficient to hold two adult men.

The first embodiment of the lower assembly may be used with the embodiments of the treepod assembly illustrated in FIGS. 1-7. Optionally, a treepod assembly may include the lower assembly, a pocket 3, and a suspension element 2 without a tent 1. Accordingly, the lower assembly may form a platform positioned above the pocket 3. After the treepod assembly is suspended above the ground, a tent 1 or structure of any type may subsequently be placed on the platform.

Figure 10A:
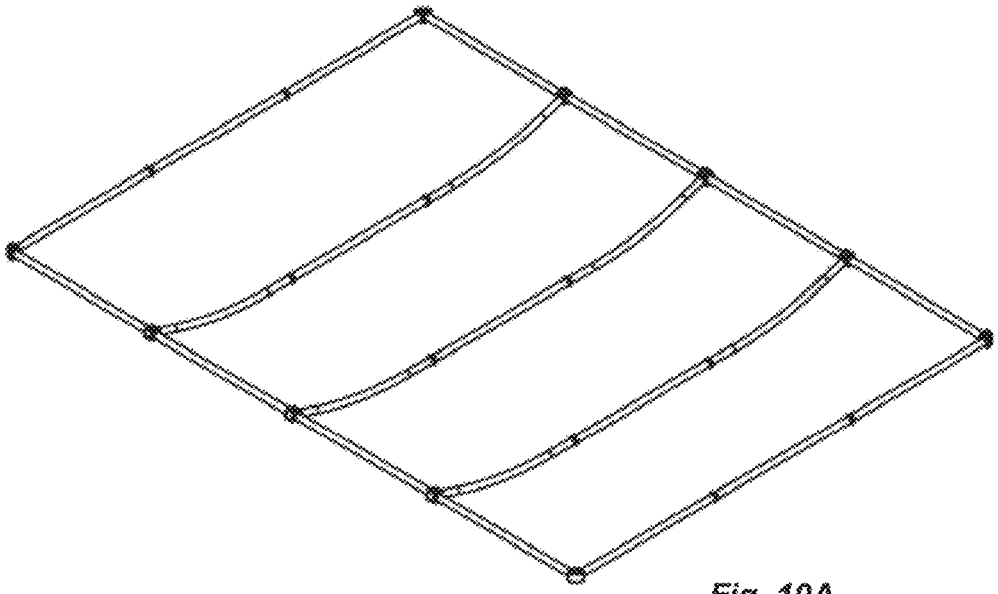
FIGS. 10A and 10B illustrate a second embodiment of a lower assembly according to the present invention.
Figure 10B:
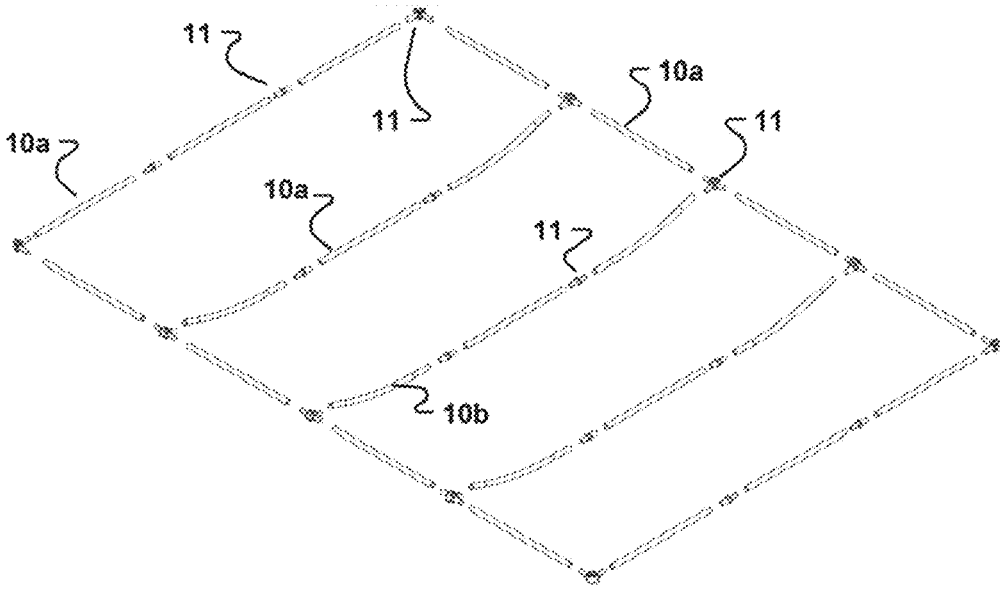
Figure 11A:
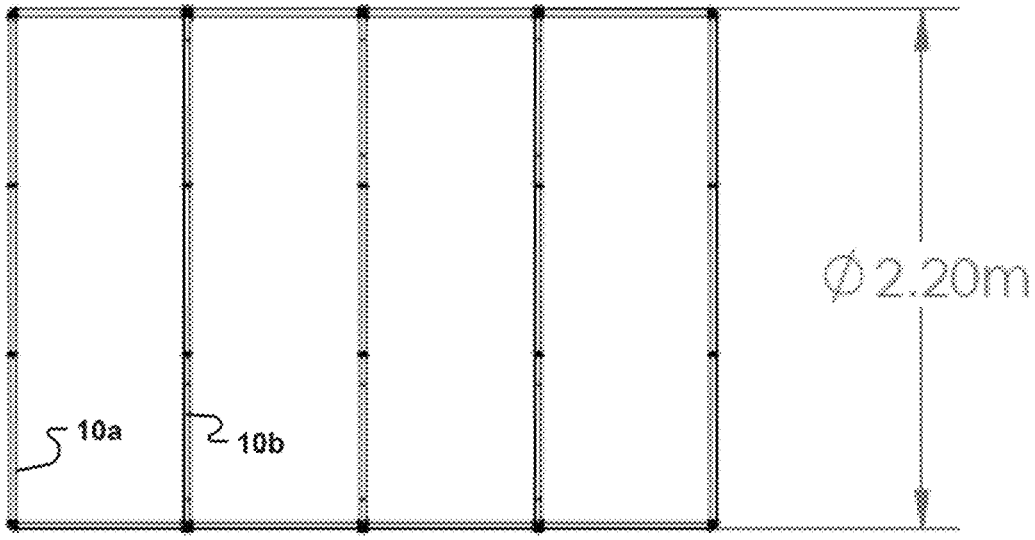
FIGS. 11A, 11B, and 11C are top, front elevation, and right side views, respectively, of the second embodiment of a lower assembly according to the present invention.
Figure 11B:
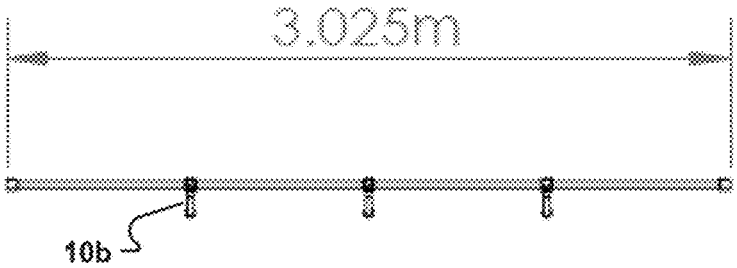
Figure 11C:
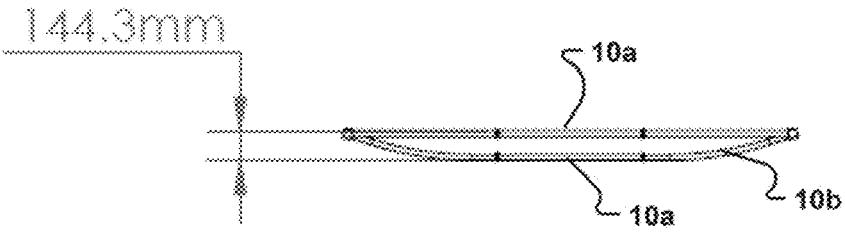
Figure 13:
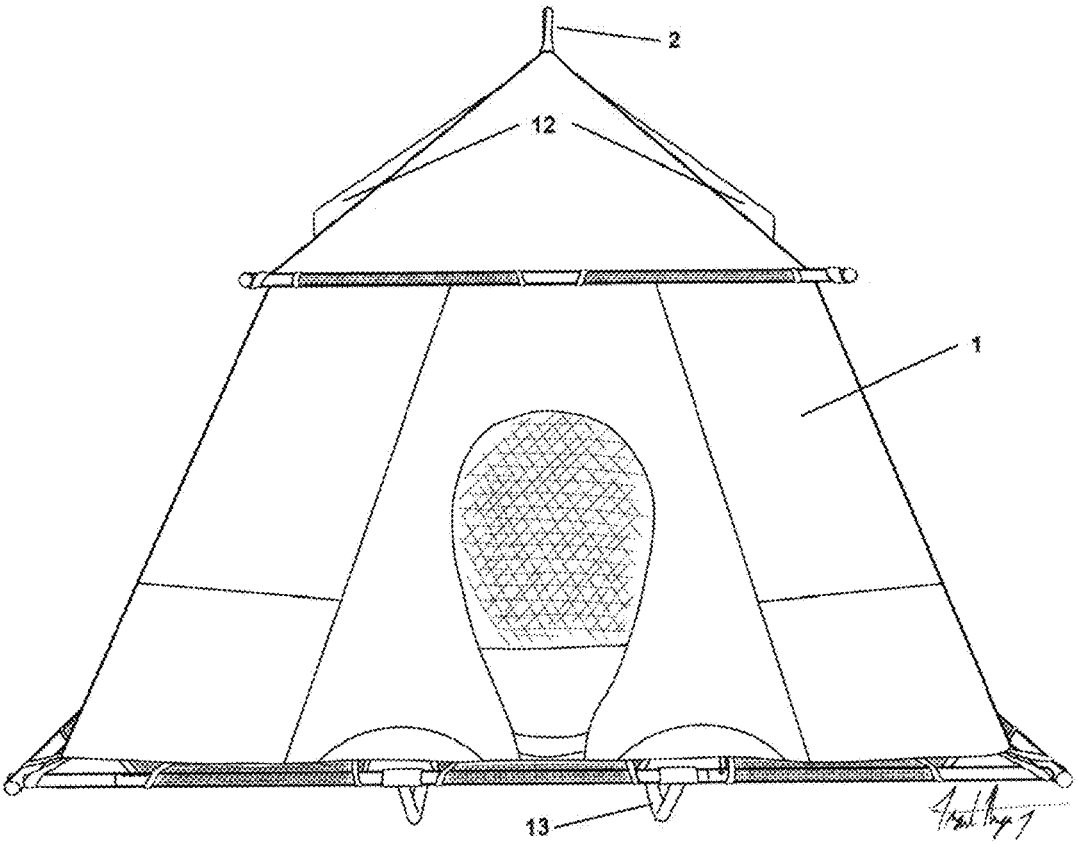
FIG. 13 is a front view of a treepod assembly according to the present invention.
Figure 14:
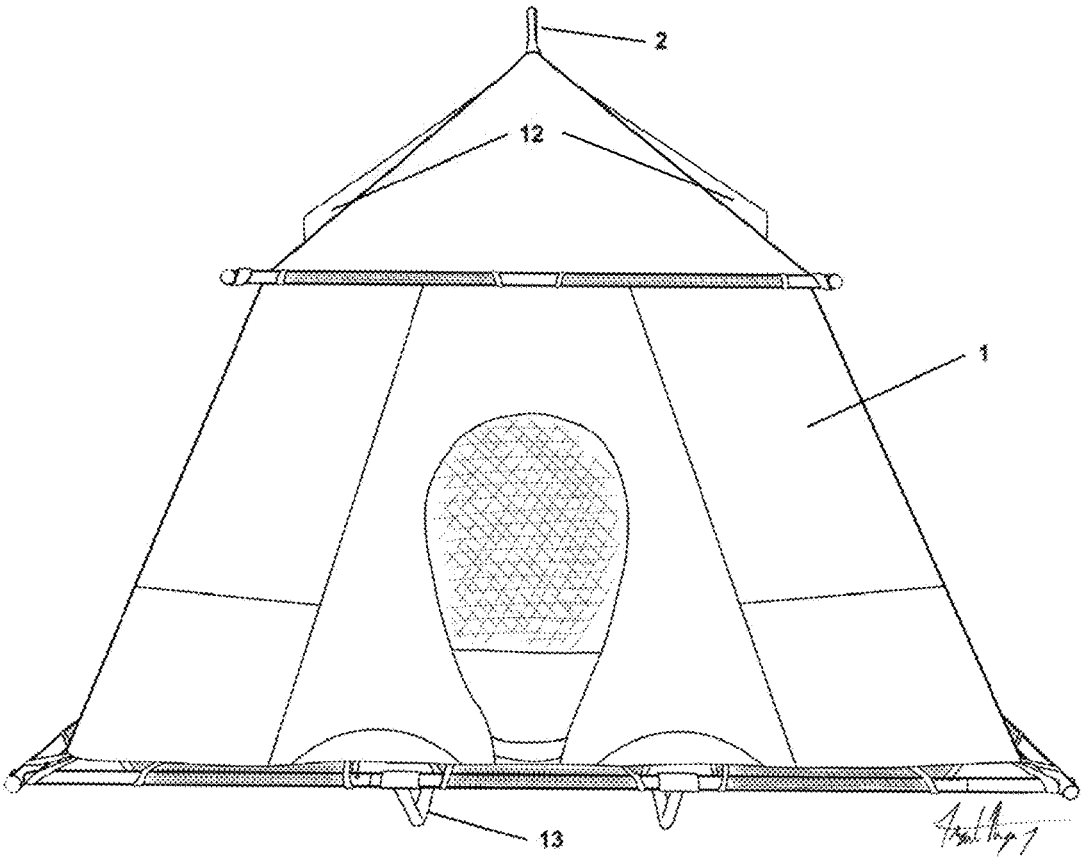
FIG. 14 is a back view of a treepod assembly according to the present invention.
Figure 15:
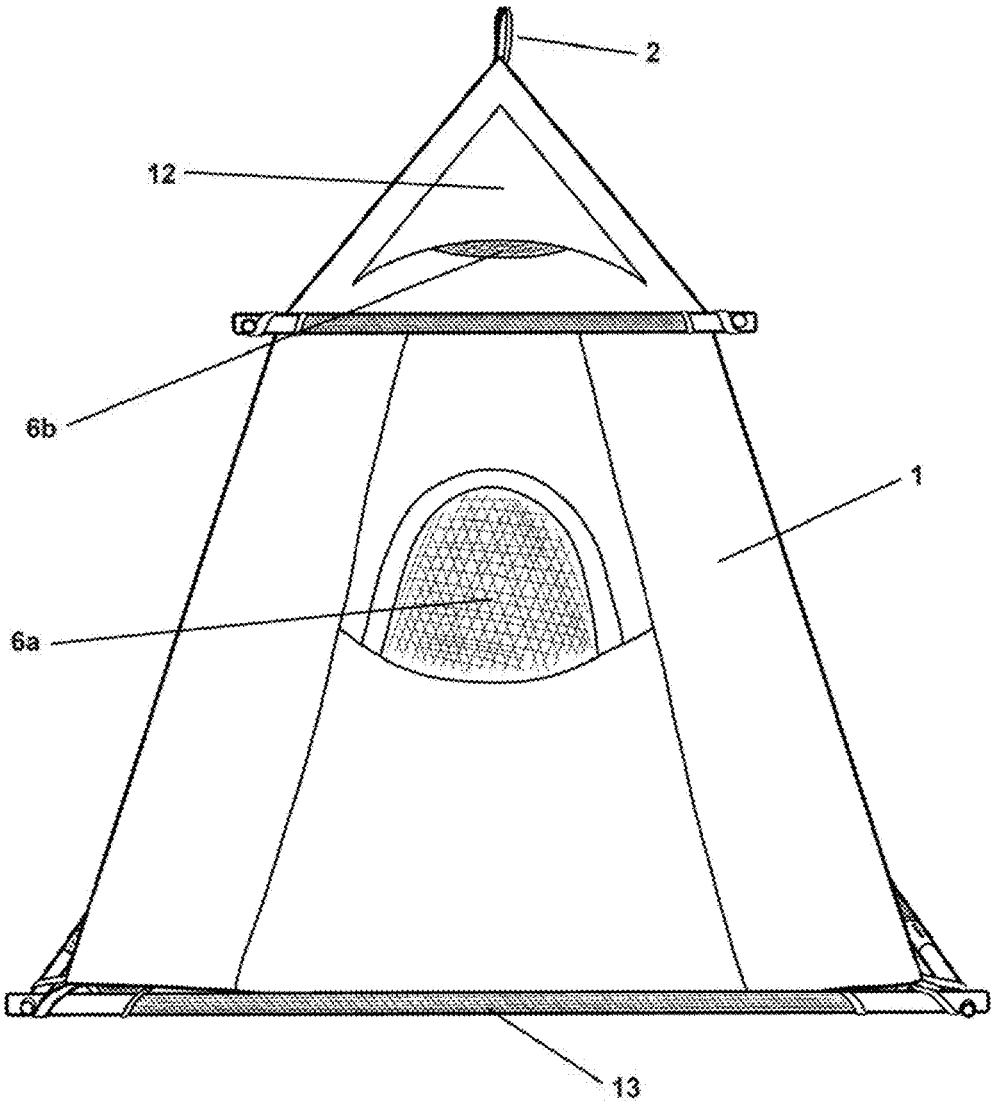
FIG. 15 is a left view of a treepod assembly according to the present invention.
Figure 16:
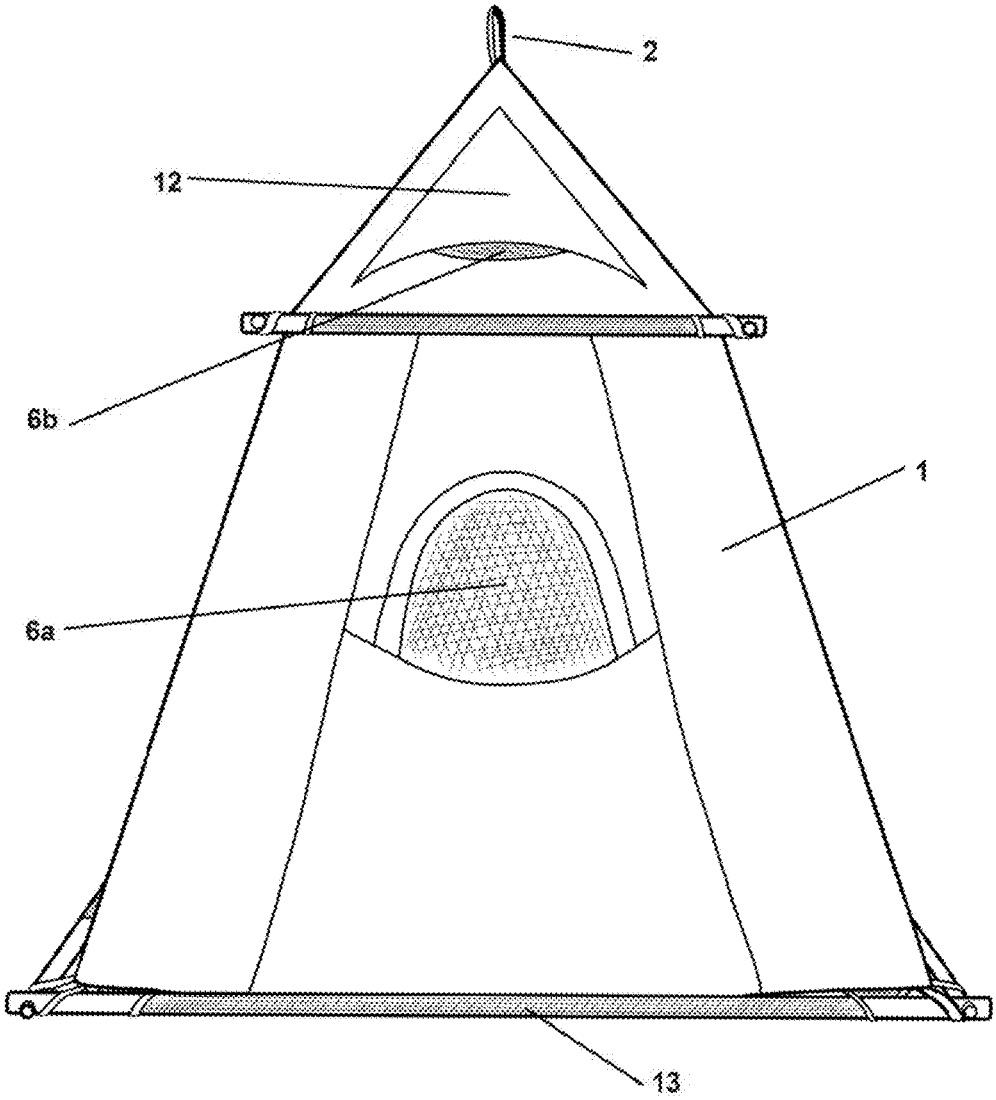
FIG. 16 is a right view of a treepod assembly according to the present invention.
Figure 17:
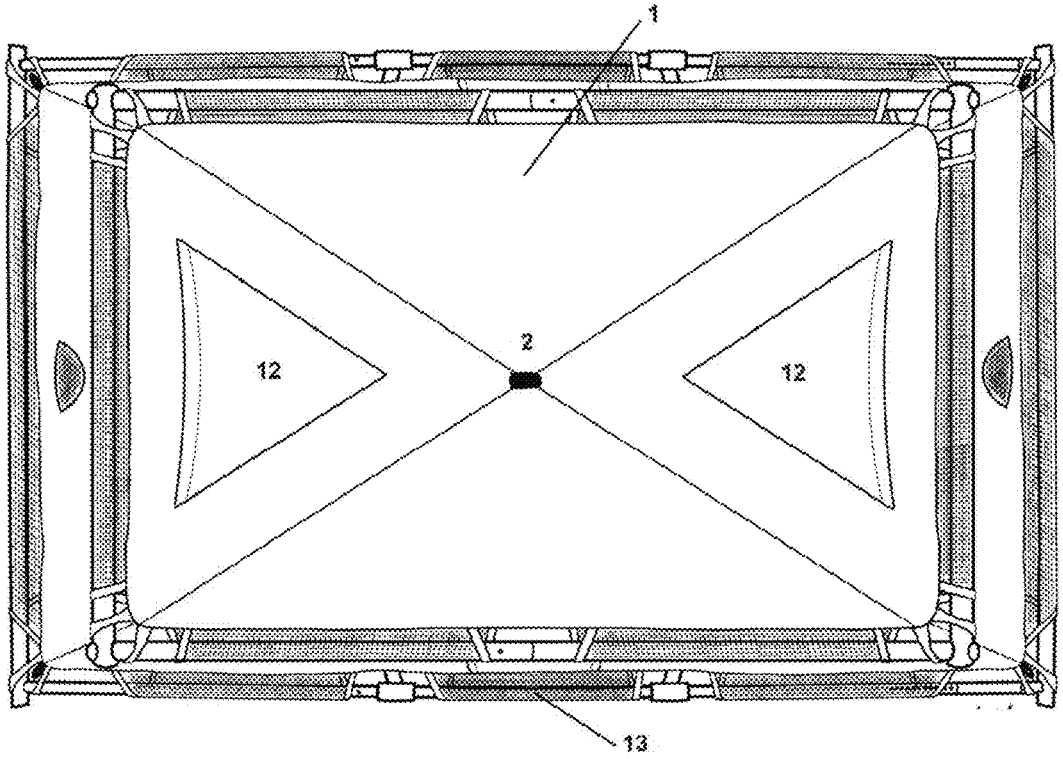
FIG. 17 is a top view of a treepod assembly according to the present invention.
Figure 18:
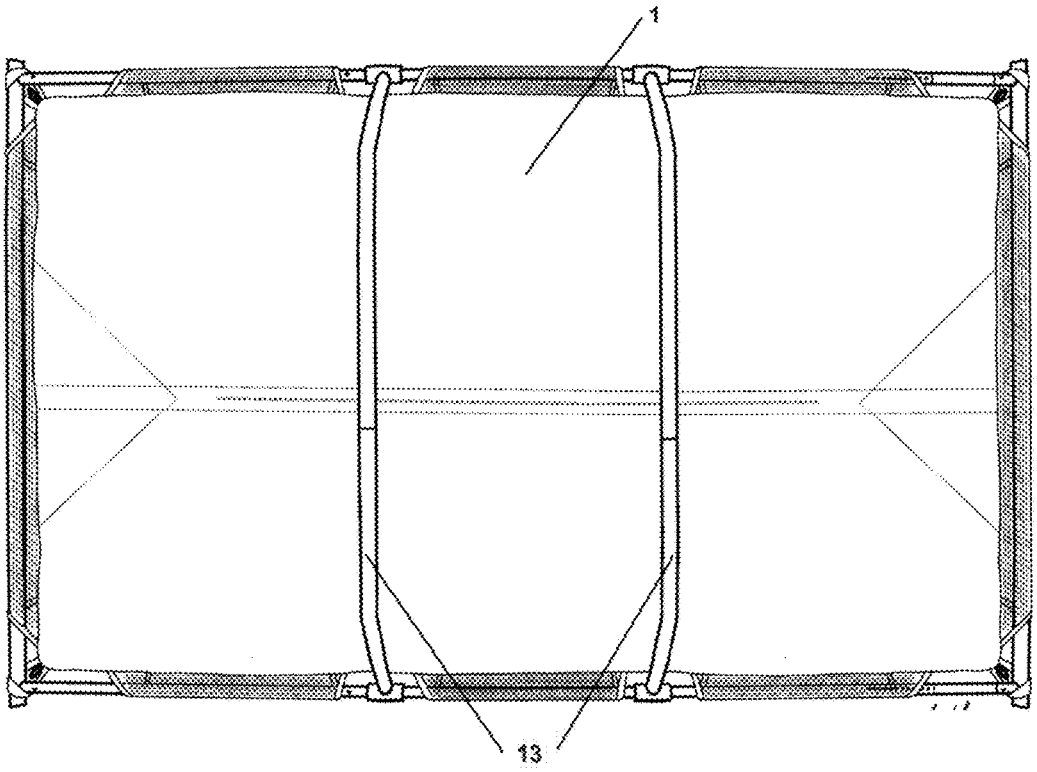
FIG. 18 is a bottom view of a treepod assembly according to the present invention.

Referring now to FIGS. 10 and 11, a second embodiment of a lower assembly is illustrated. The second embodiment of the assembly may be the same as, or similar to, the first embodiment. Accordingly, the second embodiment of the assembly may be formed of the same or similar rods 10*a,b* and connectors 11 as the first embodiment. In one embodiment, the second embodiment of the assembly has at least one of a different length and a different width from the first embodiment. The second embodiment of the lower assembly may have a size sufficient to hold two to four adult men. Accordingly, the second embodiment may have a length of between about 6 feet and about 12 feet and a width of between about 5 feet and about 9 feet. As illustrated in FIGS. 11A and 11B, the length may be about 3.025 meters, or about 9.9 feet, and the width may be about 2.20 meters, or about 7.2 feet. In one embodiment, the assembly has a height of less than about 6 inches, particularly about 144.3 millimeters, as illustrated in FIG. 13C. Additionally or alternatively, the second embodiment of the lower assembly may include a greater number of rods 10*a,b* and connectors 11 than the first embodiment of the assembly.

Similar to the first embodiment, the second embodiment of the lower assembly may be used with the embodiments of the treepod assembly illustrated in FIGS. 1-7. In one embodiment, a treepod assembly may comprise the second lower assembly, a pocket 3, and a suspension element 2 without a tent 1.

The rods 10*a,b* and connectors 11 of the lower assemblies of all embodiments of the present disclosure may be comprised of any suitably strong and substantially rigid material. In one embodiment, the rods 10*a,b* are formed of aluminum.

In one embodiment, the connectors 11 are formed of aluminum. In another embodiment, the connectors 11 are formed of plastic.

Referring now to FIGS. 12-18, another treepod assembly of an embodiment of the present invention is illustrated. The treepod assembly illustrated in FIGS. 12-18 differs from the treepod assembly illustrated in FIGS. 1-7 in that it has an approximately rectangular, rather than round, footprint. The treepod assembly illustrated in FIGS. 12-18 may also be larger than the treepod assembly illustrated in FIGS. 1-7, and may be able to securely accommodate a total weight of at least about 500 pounds while suspended above the ground.

The treepod assembly illustrated in FIGS. 12-18 generally comprises a tent 1 and a suspension element 2. Although not illustrated, the treepod assembly may also include attachment points for interconnection of stability lines. The attachment points may comprise hooks. Additionally or alternatively, the attachment points may comprise loops of fabric or cord. In one embodiment, the treepod assembly includes at least three attachment points spaced radially around a portion of the treepod assembly, proximate to a bottom portion.

The tent 1 includes at least one opening 4 to an internal chamber (not marked). The opening(s) 4 may include a closure, such as, by way of non-limiting example, a zipper, which may allow a user of the treepod assembly to selectively reconfigure the opening(s) 4 between an open configuration and a closed configuration to selectively allow or prevent entry into or exit from the tent 1. One or more windows or vents 6 may also be formed on the tent 1; in the embodiment illustrated in FIGS. 12-18, the tent comprises a window 6*a* and a vent 6*b* on each of the left side and the right side. In this embodiment, windows 6*a* and vents 6*b* differ in that the windows 6*a* are larger and more easily accessible to enable a user to view the external environment while keeping opening(s) 4 closed, while vents 6*b* are smaller, located higher up on the left and right faces of the tent, and provided primarily for the purpose of enabling air flow between the internal chamber and the external environment. Vents 6*b* may optionally be partially covered by a vent cover 12 to allow air to circulate between the internal chamber and the external environment but prevent rain or small debris from entering the internal chamber. As illustrated in FIGS. 12-18, the windows 6*a* and/or vents 6*b* may be substantially semicircular, and may be disposed on all or less than all of the external faces of the tent 1; by way of non-limiting example, windows 6*a* and vents 6*b* may be disposed on only the lateral, i.e. left and right, faces of the tent 1, but any combination of windows 6*a* and vents 6*b* on none, all, or any combination of faces of the tent 1 is within the scope of the present invention.

The treepod assembly illustrated in FIGS. 12-18 further comprises a rigid rectangular frame 13. The frame 13 and the floor of the internal chamber are made of appropriate materials and configured to support one or more occupants, and optionally other items such as camping or hiking equipment. The frame 13 may be interconnected to flexible support elements 14 (see FIG. 12) of the tent 1.

Any suitable material may be used to form the frame 13. In embodiments, the frame 13 may comprise, by way of non-limiting example, aluminum, a lightweight metal or alloy, or a plastic material. Additionally or alternatively, the frame 13 may include a stretchable cord, such as a shock cord.

Although not shown in FIGS. 12-18, the treepod assembly may comprise one or more flexible support elements. In one embodiment, a flexible support element is comprised of a flap attached at a lower surface to the floor of the assembly, and further comprising a strap, wire, cable or cord on the upper surface of the flap. In this embodiment, the strap or equivalent may further be attached to the suspension element, and either tightened or loosened via a buckle, latch, etc. Thus, the user may adjust the tension between the suspension element 2 and the flexible support element(s) to account for load bearing, sag, etc. Flexible support elements of the tent 1 may be formed of any suitable strap, wire, cable or cord. In embodiments, the flexible support elements may have an elastic elongation that is relatively low, and/or may comprise, by way of non-limiting example, one or more of an HMPE, AmSteel®, AmSteel-Blue®, and a UHMWPE such as Dyneema®.

The suspension element 2 may comprise a hook or loop of any type with sufficient strength to support the treepod assembly and its occupants from an elevated structure, such as a tree. Although only one suspension element 2 is illustrated, it will be appreciated that the treepod assembly may include any number of suspension elements 2. For example, the treepod assembly may include two, three, four, or more suspension elements 2. In the treepod assembly illustrated in FIGS. 12-18, the suspension element 2 is disposed atop the treepod assembly, but the suspension element(s) 2 may be disposed on any suitable external surface of the treepod assembly. In a preferred embodiment, suspension element(s) 2 and frame 13 of the treepod assembly are capable of securely supporting a weight of at least about 500 pounds.

It will be understood by those skilled in the art that a treepod assembly according to the present invention may have any combination of features of the embodiments disclosed in the foregoing description or illustrated in the drawings. By way of non-limiting example, a treepod assembly according to the present invention may have a pocket 3 as illustrated in FIGS. 1-7, or a frame 13 as illustrated in FIGS. 12-18, or both. Those skilled in the art will understand how to choose an appropriate combination of features for a particular application, and all such combinations are contemplated by the present invention.

The description of the present disclosure has been presented for purposes of illustration and description, but is not intended to be exhaustive or limiting of the treepod assembly to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

The invention claimed is:

1. A treepod assembly, comprising:

a tent, comprising a first layer of material defining an internal chamber having an opening and a floor, the floor being adapted to support at least one occupant;

at least one suspension element, the at least one suspension element having sufficient strength to support the weight of the treepod assembly and the at least one occupant while the treepod assembly is suspended above the ground by the suspension element from an elevated structure;

a second layer of material interconnected to the first layer of material to define a pocket that extends from the tent; and at least one aperture in the second layer of material configured to allow air to enter the pocket without obstruction to inflate the pocket when the treepod assembly is suspended, the aperture further configured to restrict the flow of air out of the pocket.

2. The treepod assembly of claim 1, further comprising a rigid frame disposed below and supporting the tent, the rigid frame being interconnected to flexible support elements of the tent and comprising a plurality of rods interconnected by connectors.

3. The treepod assembly of claim 2, wherein the rigid frame has a length of between about 6 feet and about 12 feet and a width of between about 3 feet and about 9 feet.

4. The treepod assembly of claim 2, wherein at least one rod has an arcuate shape to provide a depression in a medial portion of the treepod assembly.

5. The treepod assembly of claim 2, wherein the frame comprises at least one material selected from the group consisting of aluminum, a lightweight metal, a lightweight alloy, a plastic material, and a stretchable cord.

6. The treepod assembly of claim 1, wherein the at least one suspension element comprises a hook or loop disposed on a top of an external surface of the tent.

7. The treepod assembly of claim 1, having a substantially circular footprint.

8. The treepod assembly of claim 1, having a substantially rectangular footprint.

9. A treepod assembly, comprising:

a tent having a substantially circular footprint and comprising an internal chamber defined by a first layer of material having an opening and a floor, the floor being adapted to support at least one occupant;

at least one suspension element, the at least one suspension element having sufficient strength to support the weight of the treepod assembly and the at least one occupant while the treepod assembly is suspended above the ground by the suspension element from an elevated structure;

a second layer of material interconnected to the first layer of material to provide a pocket such that when the treepod assembly is suspended, the second layer of material drapes freely away from the first layer of material and the tent; and at least one aperture in at least one of the floor of the first layer of material and the second layer of material, configured to allow air to enter the pocket without obstruction and thereby inflate the aperture when the treepod assembly is suspended, the aperature further configured to restrict the flow of air out of the pocket.

10. The treepod assembly of claim 9, wherein the floor is sufficiently rigid to support the weight of at least one occupant without further structural reinforcement.

11. The treepod assembly of claim 9, wherein the first and second layers of material are made of the same material.

12. The treepod assembly of claim 9, wherein the at least one aperture comprises at least two apertures, the at least two apertures being substantially evenly spaced axially on the second layer of material.

13. The treepod assembly of claim 9, capable of supporting a weight of at least about 500 pounds when suspended above the ground.

14. A treepod assembly, comprising:

a tent having a substantially rectangular footprint and comprising an internal chamber defined by a first layer of material and having at least one opening and a floor, and at least one of a vent and a window;

a second layer of material interconnected to the first of material to define a pocket that extends from the tent;

at least one aperture in the second layer of material configured to allow air to enter the pocket without obstruction to inflate the pocket when the treepod assembly is suspended above the ground, the aperture further configured to restrict the flow of air out of the pocket;

at least one suspension element; and a rigid, substantially rectangular frame associated with the floor.

15. The treepod assembly of claim 14, wherein the at least one of a vent and a window is substantially semicircular.

16. The treepod assembly of claim 14, wherein the at least of a vent and a window comprises at least one vent, the at least one vent being partially covered by a vent cover disposed on an external face of the tent.

17. The treepod assembly of claim 14, wherein the at least one of a vent and a window is disposed on an external face of the tent other than the face on which the at least one opening is disposed.

18. The treepod assembly of claim 14, wherein the at least one suspension element comprises a hook or loop disposed on a top of an external surface of the tent.

19. The treepod assembly of claim 14, capable of supporting a weight of at least about 500 pounds when suspended.

* * * * *